US011280122B2

(12) United States Patent
Dolnik

(10) Patent No.: US 11,280,122 B2
(45) Date of Patent: Mar. 22, 2022

(54) BAR LOCK ASSEMBLY

(71) Applicant: John E. Dolnik, Pleasant Prairie, WI (US)

(72) Inventor: John E. Dolnik, Pleasant Prairie, WI (US)

(73) Assignee: POWERBRACE CORPORATION, Kenosha, WI (US)

( * ) Notice: Subject to any disclaimer, the term of this patent is extended or adjusted under 35 U.S.C. 154(b) by 692 days.

(21) Appl. No.: 16/162,117

(22) Filed: Oct. 16, 2018

(65) Prior Publication Data

US 2020/0115934 A1 Apr. 16, 2020

(51) Int. Cl.

| | |
|---|---|
| ***E05B 83/10*** | (2014.01) |
| ***E05B 79/10*** | (2014.01) |
| ***E05B 77/16*** | (2014.01) |
| ***E05B 85/16*** | (2014.01) |
| ***E05B 85/22*** | (2014.01) |
| ***E05B 79/06*** | (2014.01) |

(52) U.S. Cl.

CPC ..... *E05B 83/10* (2013.01); *E05B 77/16* (2013.01); *E05B 79/06* (2013.01); *E05B 79/10* (2013.01); *E05B 85/16* (2013.01); *E05B 85/22* (2013.01)

(58) Field of Classification Search

CPC ..... E05B 83/02; E05B 83/08; E05B 83/10; E05B 79/06; E05B 79/10; E05B 79/16; E05B 85/16; E05B 85/22; E05B 77/16; Y10S 292/32

See application file for complete search history.

(56) References Cited

U.S. PATENT DOCUMENTS

| | | | | |
|---|---|---|---|---|
| 2,757,031 | A * | 7/1956 | Levin | E05C 9/043 292/5 |
| 2,799,900 | A * | 7/1957 | Gardner | B61D 19/001 49/142 |
| 2,944,303 | A * | 7/1960 | Uphues | B61D 19/009 49/219 |
| 3,633,954 | A * | 1/1972 | Tantlinger | E05C 9/008 292/217 |
| 5,110,164 | A * | 5/1992 | Whiteman | E05B 83/10 292/36 |
| 6,173,475 | B1 | 1/2001 | Senn et al. | |
| 6,581,425 | B1 * | 6/2003 | Brown | E05B 83/02 292/150 |

(Continued)

*Primary Examiner* — Christine M Mills
*Assistant Examiner* — Christopher F Callahan
(74) *Attorney, Agent, or Firm* — Law Office of John W. Harbst

(57) ABSTRACT

A bar lock assembly including a lock rod having first and second lock rod portions and defines a rotational axis. A second lock rod portion section telescopically extends from the first lock rod portion when the bar lock assembly is in a first condition. The second lock rod portion is substantially retracted within the first lock rod portion when the bar lock assembly is in a second condition. An elongated handle having opposed ends extends from the first lock rod portion. One handle end is pivotally connected to the first lock rod about a fixed axis. Linkage between the handle and the second lock rod portion telescopically moves the second lock rod portion. This lock bar assembly is configured such that an angle of about 45° is established between the handle and a generally horizontal plane when in the first position to enhance ergonomic operation of the bar lock assembly.

23 Claims, 6 Drawing Sheets

(56) References Cited

U.S. PATENT DOCUMENTS

| | | | |
|---|---|---|---|
| D481,295 | S | 10/2003 | Senn |
| D494,840 | S | 8/2004 | Senn |
| 6,779,818 | B2 | 8/2004 | Senn |
| D495,583 | S | 9/2004 | Senn |
| D500,441 | S | 1/2005 | Senn |
| D518,358 | S | 4/2006 | Senn |
| 7,234,755 | B1 | 6/2007 | Senn |
| 7,306,267 | B2 | 12/2007 | Senn |
| D567,065 | S | 4/2008 | Senn |
| D570,208 | S | 6/2008 | Senn |
| 7,497,170 | B2 | 3/2009 | Fortuna et al. |
| D675,130 | S | 1/2013 | Senn |
| 8,381,554 | B2 | 2/2013 | Senn |
| 8,517,436 | B2 | 8/2013 | Senn |
| 8,746,152 | B2 | 6/2014 | Chamsy et al. |
| 8,752,487 | B2 | 6/2014 | Senn et al. |
| 9,522,683 | B2 | 12/2016 | Senn et al. |
| 9,908,541 | B2 | 3/2018 | Centeno et al. |
| 9,950,713 | B2 | 4/2018 | Senn et al. |

* cited by examiner

BAR LOCK ASSEMBLY

FIELD OF THE INVENTION DISCLOSURE

The present invention disclosure generally relates to storage containers, such as mobile storage containers, having one or more access doors, and, more specifically, to a bar lock assembly for releasably maintaining such one or more doors in a releasably closed position.

BACKGROUND

Van type trucks, semi-trailers and other cargo containers, hereinafter generally referred to as a "container" and or "cargo container" have a walled enclosure or body with a generally rectangular door frame typically arranged toward one end of the container. One or more doors on the container are hingedly or pivotally connected along one side of the door frame whereby permitting the doors to swing within the plane of the door frame and are used to relesably close the open end of the container. In some designs, the container has a generally horizontal floor extension extending across and outwardly beneath a lower edge of the door.

To maintain the door in a releasably closed position, a form of bar lock assembly is known to be provided between the door and the walled enclosure. Such a bar lock assembly is typically fabricated from several different components or pieces. For example, in one form, the bar lock assembly includes an axially elongated bar or rod which is mounted to an exterior side of and adjacent a side edge of the door for rotation about a fixed axis extending generally parallel to the axis about which the door pivots. The elongated rod or bar typically has a locking handle extending therefrom for rotating the elongated bar or rod about its axis. As known, and toward an upper end thereof, the elongated rod or bar typically has a locking cam arranged for interengaging relationship with a keeper secured to a header on the door frame. Upon suitable rotation of the locking rod, the locking cam cooperates and coacts with the keeper to releasably maintain the door in the closed position.

In some known bar lock designs, the elongated bar or lock rod includes a first elongated portion and a second portion arranged in telescoping relation relative to each other. A lengthwise section of the second portion of the lock rod projects or extends from a lower end of the first elongated portion and is configured to be received in an aperture defined by the floor extension so as to secure the lower end of the door in the releasably closed position. With this design, a manually operated linkage typically connects the handle of the bar lock assembly to the second portion of the lock rod. Upon lifting of the handle, the second portion of the lock rod is manually retracted within the first portion of the lock rod such that it is removed from the confines of the aperture whereby allowing the bar lock assembly to be moved to an unlocked condition upon which the door can be opened.

These known bar lock assemblies having a two-piece elongated bar or lock rod suffer certain problems and disadvantages. First, the linkage used to interconnect the handle with the second portion of the lock rod typically includes multiple links and pivot points which add to the manufacturing costs and complexity of the bar lock assembly. Second, with those known bar lock assemblies which utilize a two-piece lock rod, the locking handle is normally disposed generally parallel to the ground when the bar lock assembly is in a locked condition. As such, the locking handle needs to be simultaneously raised above horizontal and rotated when the door is to be opened. This action usually requires the operator to use two hands to unlock and open the door. Briefly stated, the ergonomics of these known bar lock assemblies is not friendly or beneficial to the operator. Moreover, with those known bar lock assemblies which utilize a two-piece lock rod, nothing is provided to hold the second portion of the lock rod in a manually retracted telescopic position relative to the first lock rod portion once the handle is released. As such, the second portion of the lock rod tends to gravitationally fall and must be again retracted before the door can be returned to a fully closed and locked condition. If not, and when the door is swung toward a closed position, the extended second portion of the lock rod can unexpectedly engage with and possibly cause damage to any one or all of the bar lock assembly components, or the generally horizontal floor extension on the container, or the elongated lock rod which can leads to the need for repairs to the container, downtime and unexpected costs.

In view of the above, there is both a need and a desire for a bar lock assembly which is simple to manufacture, ergonomically beneficial to operate with improved structure and operation.

SUMMARY

In view of the above, and in accordance with one aspect of this invention disclosure, there is provided a bar lock assembly including a lock rod defining a rotational axis for the bar lock assembly and has a first elongated lock rod portion and a second lock rod portion arranged in telescoping relationship relative to each other. A lengthwise section of the second lock rod portion extends from a first end of said first lock rod portion when the bar lock assembly is in a first condition. The second lock rod portion is substantially retracted within the first lock rod portion when the bar lock assembly is in a second condition. An elongated handle with opposed ends extends from the lock rod. One end of the handle is pivotally connected to the first lock rod portion to effect rotational movements of the bar lock assembly about the rotational axis. The handle moves in a fixed arc about a fixed pivot point whereat the handle is connected to the first lock rod portion. Linkage connected between the handle and the second lock rod portion telescopically moves the second lock rod portion relative to the first lock rod portion in response to pivotal movement of the handle about the first pivot point. To enhance the ergonomics of this bar lock assembly, the linkage and handle are configured such that an included acute angle ranging between about 35° and about 50° is defined between the handle and the longitudinal axis of the bar lock assembly when the bar lock assembly is in the first or locked condition.

Preferably, the bar lock assembly further includes a locking cam coupled to a second end of the first elongated lock rod portion and adapted to engage a lock rod keeper. In one form, structure is provided to articulately connect the linkage to the second lock rod portion of the bar lock assembly. In one embodiment, such structure serves as a positive stop for limiting pivotal movement of the handle about the fixed pivot point.

In one embodiment, the bar lock assembly further includes structure for limiting axial displacement of the second lock rod portion while permitting rotational fore-and-aft movements of the first lock rod portion about the rotational axis of the bar lock assembly. The bar lock assembly furthermore preferably includes structure for simultaneously rotating both the first and second lock rod portions as the handle rotates the bar lock assembly about its rotational axis.

According to another aspect of this invention disclosure, there is provided a bar lock assembly having a lock rod defining a rotational axis for the bar lock assembly. The lock rod includes a first elongated lock rod portion and a second lock rod portion arranged in telescoping relationship relative to each other. A lengthwise section of the second lock rod portion extends from a first end of the first lock rod portion when the bar lock assembly is in a first condition. The second lock rod portion is substantially retracted within the first lock rod portion when the bar lock assembly is in a second condition. An elongated handle extends from the lock rod and has opposed ends. One end of the handle is pivotally connected to the first lock rod portion to effect rotational movements of the bar lock assembly about the rotational axis. The handle moves in a fixed arc about a fixed pivot point whereat the handle is connected to the first lock rod portion. Linkage connects the handle and the second lock rod portion and allows the second lock rod portion to telescopically move relative to the first lock rod portion in response to pivotal movement of the handle about the first pivot point. To enhance the ergonomics of the bar lock assembly, the linkage and handle are configured such that the handle is disposed generally perpendicular to the longitudinal axis of the lock rod assembly when the bar lock assembly is in the second condition.

In a preferred embodiment, the bar lock assembly further includes a locking cam coupled to a second end of the first elongated lock rod portion and adapted to engage a lock rod keeper. Preferably, structure is provided to articulately interconnect the linkage to the second lock rod portion. Such structure serves as a positive stop for limiting pivotal movement of the handle about the fixed pivot point.

In one form, the bar lock assembly further includes structure for limiting axial displacement of the second lock rod portion while permitting rotational fore-and-aft movements of the first elongated rod portion about the rotational axis of the bar lock assembly. Preferably, the bar lock assembly furthermore includes structure for simultaneously rotating both the first elongated lock rod portion and the second lock rod portion relative to each other as the handle rotates the bar lock assembly about its rotational axis.

Another feature of this invention disclosure relates to a bar lock assembly for a door of a container. The container has a generally horizontal floor extension extending across and outward from a lower surface of the door and a door frame with the door being movably mounted to the door frame. The bar lock assembly includes a lock rod configured to be mounted to the door for rotation about a fixed axis defined by said lock rod. The lock rod includes a first elongated lock rod portion and a second lock rod portion arranged in telescoping relationship relative to each other. A lengthwise section of the second lock rod portion extends from one end of the first lock rod portion and is configured to be received in an aperture defined by the floor extension to lock the door relative to the frame when the bar lock assembly is in a locked condition. The second lock rod portion is substantially retracted within the first elongated lock rod portion and is removed from the aperture defined by the floor extension when the bar lock assembly is in an unlocked condition. A locking cam is mounted to an upper end of the lock rod and adapted to engage a lock rod keeper mounted to the door frame. An elongated handle has one end pivotally connected to the first lock rod portion to effect rotational movements of the bar lock assembly about the rotational axis. The handle is movable in a fixed arc about a fixed pivot point whereat the handle is connected to the first lock rod. The handle has a free second end. Linkage connects the handle with the second lock rod portion and telescopically moves the second lock rod portion relative to the first lock rod portion in response to pivotal movement of the handle about the fixed pivot point. The linkage and handle are configured such that the handle is disposed generally parallel to a horizontal plane when the bar lock assembly is in the unlocked condition to enhance leverage during operation of the bar lock assembly.

In a preferred embodiment, the floor extension defines a closed marginal edge for the aperture. In one embodiment, the bar lock assembly further includes a two-piece hasp lock carried by the door. The two-piece hasp lock includes a first piece mounted to the door and a second piece which rotates relative to the first hasp piece about a fixed axis defined by the first hasp piece between first and second positions. When the second hasp piece is in the first position, the second hasp piece preferably cooperates with the first hasp piece to entrap a lengthwise portion of the handle therebetween and in a manner inhibiting inadvertent movements of the handle whereby inhibiting inadvertent rotation of the bar lock assembly. Preferably, and with the second hasp piece rotated to the second position, the second hasp piece is positioned to engage and position a lengthwise portion of the handle such that a free end of the second lock rod portion is releasably held above and free of the marginal edge of the aperture defined by the floor extension whereby maintaining the bar lock assembly in the unlocked condition.

Preferably, structure serves to articulately connect the linkage to the second lock rod portion, with such structure serving as a positive stop for limiting pivotal movement of the handle about the fixed pivot point. In one form, the bar lock assembly further includes structure for limiting axial displacement of the second lock rod portion while permitting rotational fore-and-aft movements of the first lock rod portion about the rotational axis of the bar lock assembly. In a preferred embodiment, the bar lock assembly furthermore includes structure for simultaneously rotating both the first lock rod portion and the second lock rod portion relative to each other as the handle rotates the bar lock assembly about its rotational axis.

According to yet another aspect of this invention disclosure, there is provided a bar lock assembly for a door of a container. The container has a generally horizontal floor extension extending across and outward from a lower surface of the door and a door frame with the door being movably mounted to the door frame. According to this aspect of the invention disclosure, the bar lock assembly has a lock rod configured to be mounted to the door for rotation about a fixed axis. The lock rod includes a first elongated lock rod portion and a second lock rod portion arranged in telescoping relationship relative to each other. A lengthwise section of the second lock rod portion extends from a lower end of the first lock rod portion and is configured to be received in an aperture defined by the floor extension to lock the door relative to the frame when the bar lock assembly is in a locked condition. The second lock rod portion is substantially retracted within the first lock rod portion and removed from the aperture defined by the floor extension when the bar lock assembly is in an unlocked condition. A locking cam is mounted to an upper end of the lock rod and adapted to engage a lock rod keeper coupled to the door frame. An elongated handle has one end pivotally connected to the first lock rod portion to effect rotational movements of the bar lock assembly about the rotational axis. The handle moves in a fixed arc about a fixed pivot point whereat the handle is connected to the first rod portion. The handle has a free second end. Linkage interconnects the handle with the second lock rod portion and telescopically moves the second lock rod portion relative to the first lock rod portion in response to pivotal movement of the handle about the fixed pivot point. The linkage and handle are configured such that the handle is disposed at an included and acute angle ranging between about 35° and about 50° relative to the longitudinal axis of the bar lock assembly when the bar lock assembly is in the locked condition.

In a preferred embodiment, the floor extension defines a closed marginal edge for the aperture. In one embodiment, the bar lock assembly further includes a two-piece hasp lock carried by the door. The two-piece hasp lock includes a first piece mounted to the door and a second piece which rotates relative to the first piece about a fixed axis defined by the first piece between first and second positions. When the second piece of the hasp lock is in the first position, the second piece preferably cooperates with the first piece of the hasp lock to entrap a lengthwise portion of the handle therebetween and in a manner inhibiting inadvertent movements of the handle whereby inhibiting inadvertent rotation of the bar lock assembly. Preferably, and with the second piece of the lock rotated to the second position, the second piece is positioned to engage and position a lengthwise portion of the handle such that a free end of the second lock rod portion is releasably held above and free of the marginal edge of the aperture defined by the floor extension whereby maintaining the bar lock assembly in the unlocked condition.

Preferably, structure is provided to articulately connect the linkage to the second lock rod portion, with such structure serving as a positive stop for limiting pivotal movement of the handle about the fixed pivot point. In one form, the bar lock assembly further includes structure for limiting axial displacement of the second lock rod portion while permitting rotational fore-and-aft movements of the first lock rod portion about the rotational axis of the bar lock assembly. In a preferred embodiment, the bar lock assembly furthermore includes structure for simultaneously rotating both the first lock rod portion and the second lock rod portion relative to each other as the handle rotates the bar lock assembly about its rotational axis.

DETAILED DESCRIPTION

Figure 1:
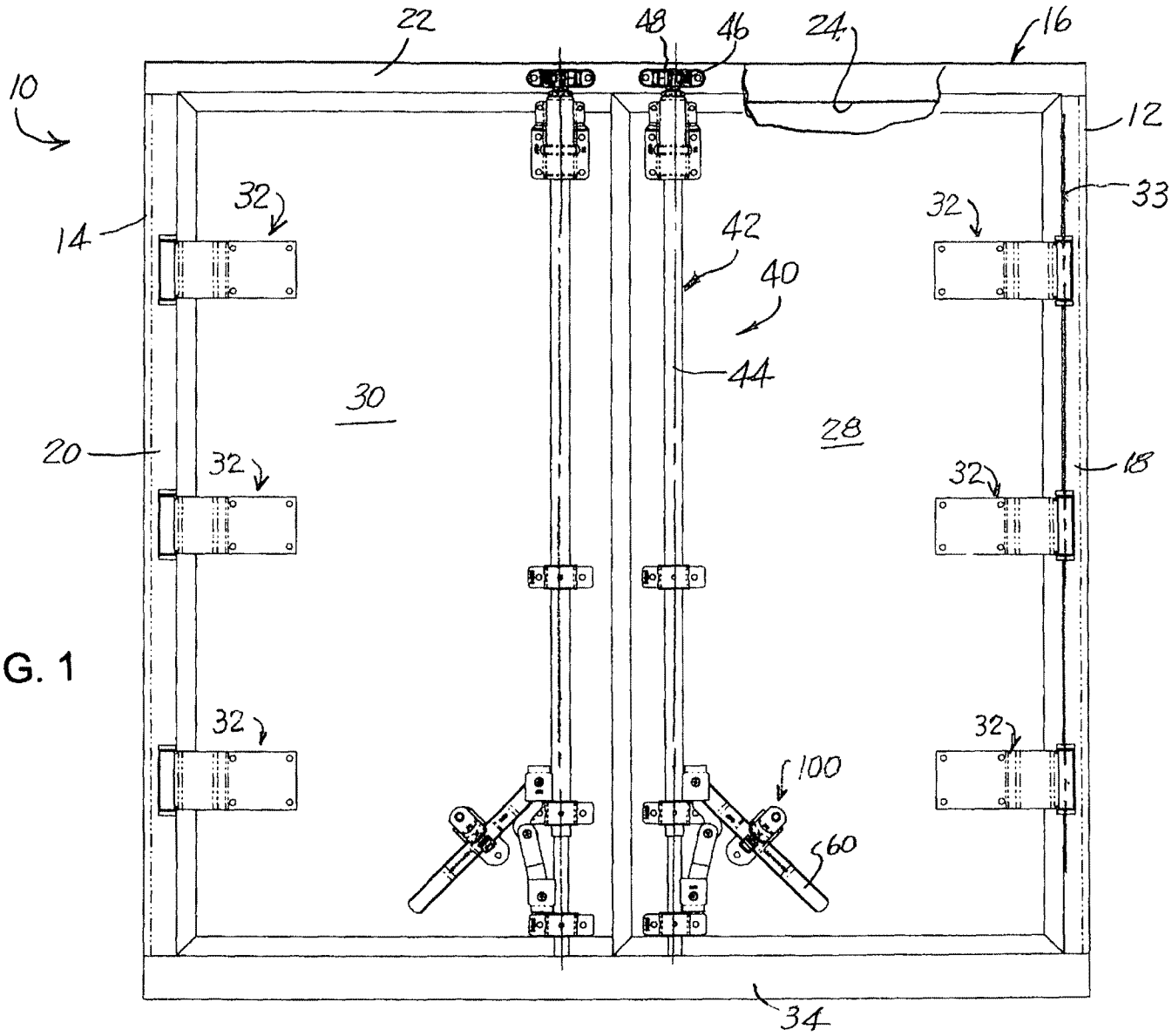
FIG. 1 is an end view of a container with a bar lock assembly embodying principals and teachings of this invention disclosure mounted thereon.

While the present invention disclosure is susceptible of embodiment in multiple forms, there is shown in the drawings and will hereinafter be described a preferred embodiment of the invention disclosure, with the understanding the present invention disclosure is to be considered as setting forth an exemplification which is not intended to limit the invention disclosure to the specific embodiment illustrated and described.

Referring now to the drawings, wherein like reference numerals indicate like parts throughout the several views, there is shown in FIG. 1 a conventional storage container or truck body 10. While the concepts of this invention disclosure are adaptable to a towable container, it will be understood they are equally applicable to storage containers generally, and more specifically, to containers for transporting objects, examples of which include, but should not limited to, straight truck bodies, mobile storage containers, small personnel and/or commercial trailers and the like.

In the embodiment illustrated by way of example in FIG. 1, container 10 includes a pair of opposing side walls 12 and 14 extending the length of the container 10 and that are attached to each other at a front end thereof and to a front wall (not shown). Rear ends of the side walls 12 and 14 are secured to each other by a door frame 16 of the container 10. As is known, the door frame 16 includes a pair of side frame members 18 and 20 which are rigidly interconnected to each other by a top frame member or header 22 extending transversely across an upper edge of the frame.16. The frame members 18, 20 and 22 cooperate to define a doorway opening 24 which permits ingress and egress to and from an interior of container 10.

In the embodiment illustrated by way of example in FIG. 1, disposed within the door frame 16 for releasably closing the opening 24 are a pair of side-by-side doors 28 and 30 which are connected along one side edge to the frame members 18 and 20, respectively, by means of hinges 32 which allow each door 28, 30 to be swung about a generally vertical axis 33 within a plane defined by the door frame 16. In the embodiment illustrated by way of example, and as well known in the art, the doors 28 and 30 are arranged relative to each other such that closure of door 28 within the doorway opening 24 will likewise releasably hold door 30 in a closed condition or position.

Figure 2:
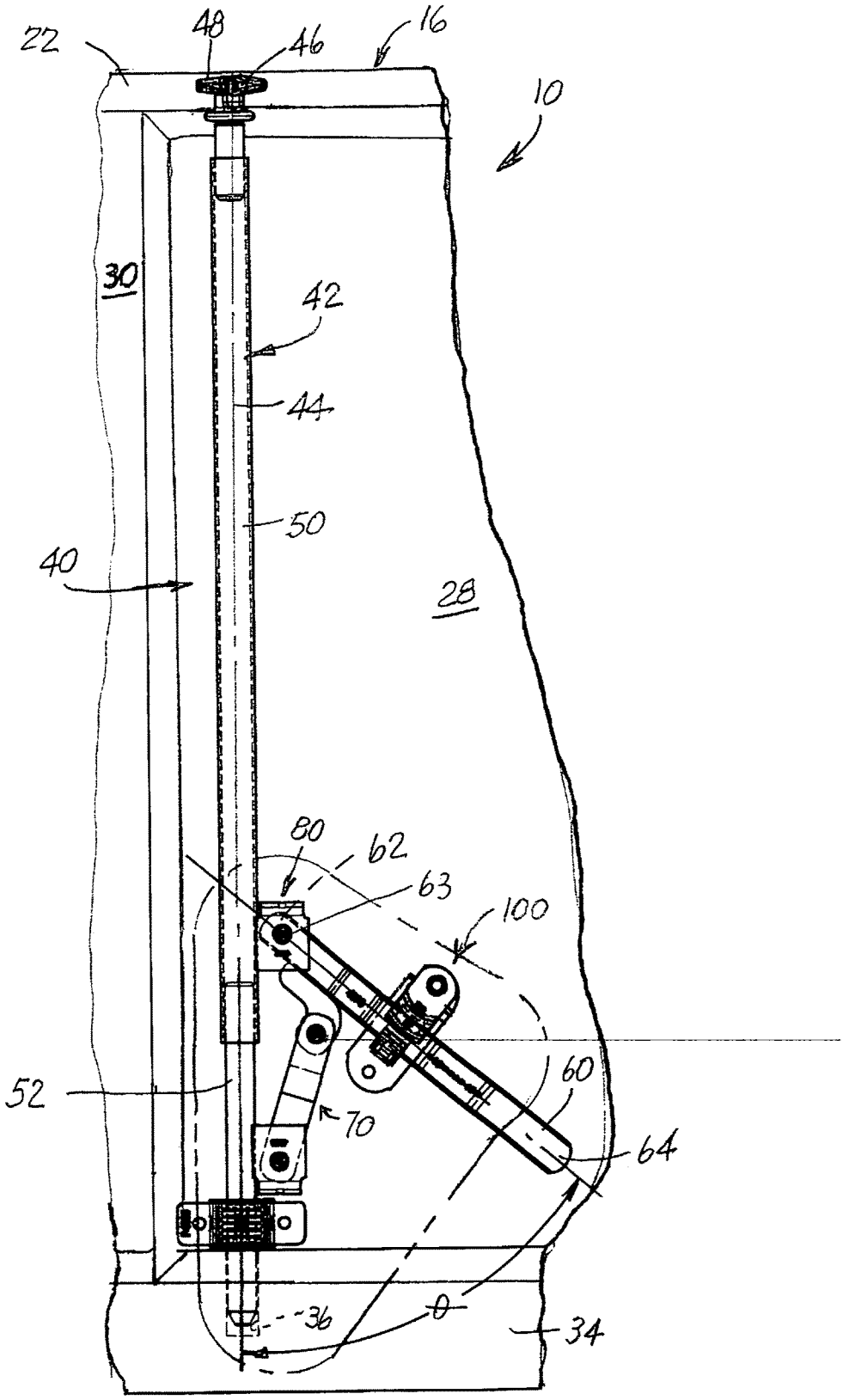
FIG. 2 is an enlarged fragmentary view of one form of bar lock assembly embodying principals and teachings of this invention disclosure in a closed or locked condition.
Figure 3:
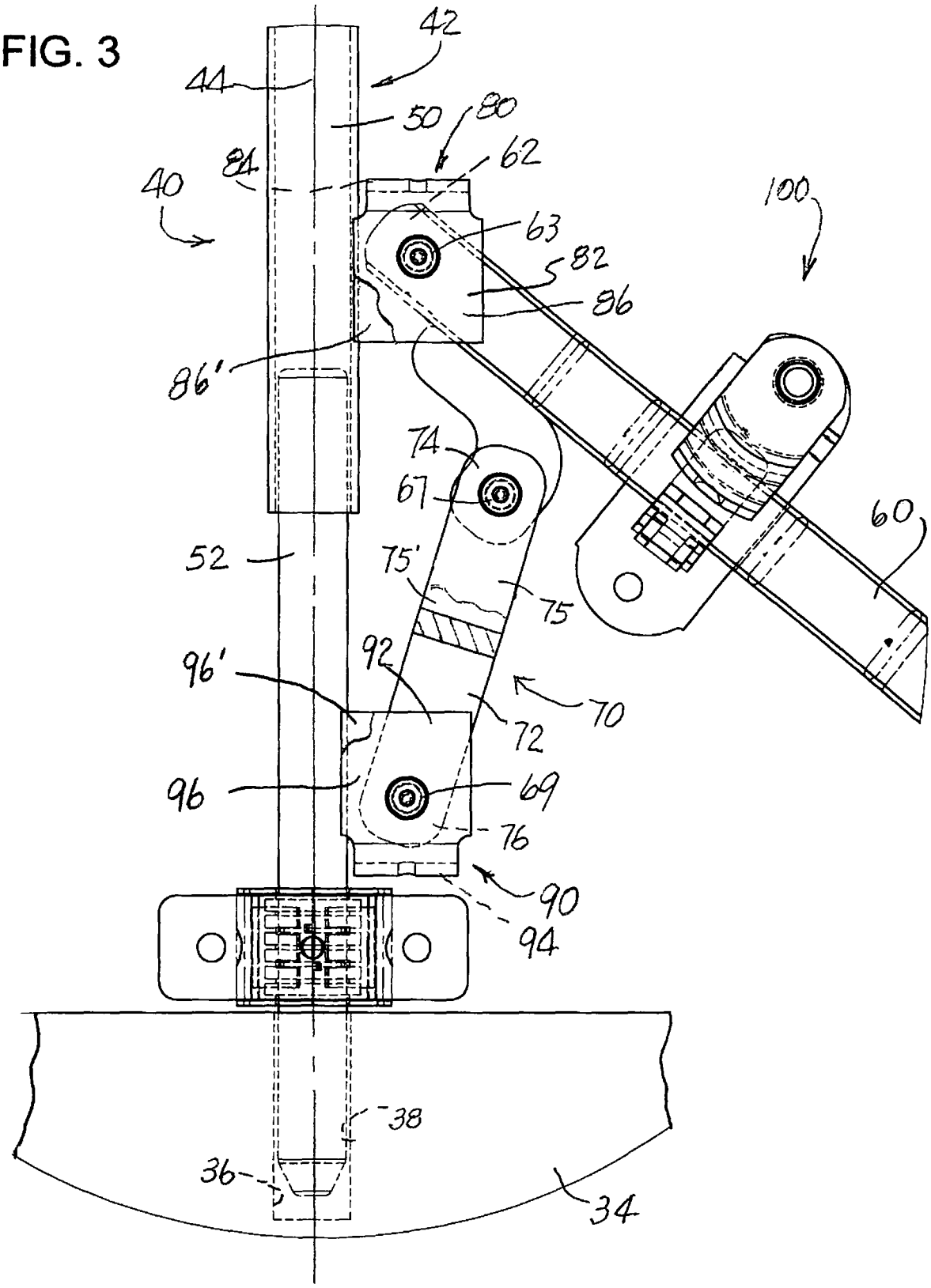
FIG. 3 is an enlarged fragmentary view of that portion of the bar lock assembly encircled in phantom lines FIG. 2.

In the embodiment illustrated by way of example in FIGS. 1 and 2, container 10 further includes a generally horizontal floor extension 34 extending across and outward from a lower edge of the doors 28 and 30. Notably, the floor extension 34 is so disposed that it underlines the lower edge of and does not interfere with either door 28, 30 as either door 28, 30 moves from a closed to an open position relative to the door frame 16. As will be described hereinafter, and as illustrated in FIG. 3, the floor extension 34 defines an aperture or opening 36. In a preferred embodiment illustrated by way of example in FIG. 3, the floor extension 34 defines a closed marginal edge 38 for the aperture or opening 36.

In the embodiment illustrated by way of example in FIGS. 1 and 2, a bar lock assembly 40 is provided on at least one of the doors 28 and 30 for releasably locking or securing the doors 28 and 30 in a position to close or conceal the interior of the container 10. The bar lock assembly 40 is configured to be conventionally mounted to at least one of the doors 28, 30 adjacent an edge of the door laterally opposite from the hinges 32. In the embodiment illustrated in FIGS. 1, 2 and 3, the bar lock assembly 40 includes an elongated lock rod 42 configured to be suitably secured to or mounted on an exterior of at least one of the doors 28, 30 for rotation. The elongated lock rod 42 defines a generally vertical rotational axis 44 for the bar lock assembly 40.

As illustrated by way of example in FIG. 1, toward an upper end thereof, the lock rod 42 is provided with conventional camming structure 46 which rotates with and in response to rotation of the lock rod 42. As is conventional, the camming structure 46 at the end of the lock rod 42 is adapted to cooperate with a keeper 48 secured to the header 22 of the door frame 16. That is, the camming structure 46 toward the end of the lock rod 42 cooperates in an interengaging relationship with the keeper 48 (FIG. 1) on header 22 to releasably maintain the doors 28, 30 in a closed position or condition.

Figure 5:
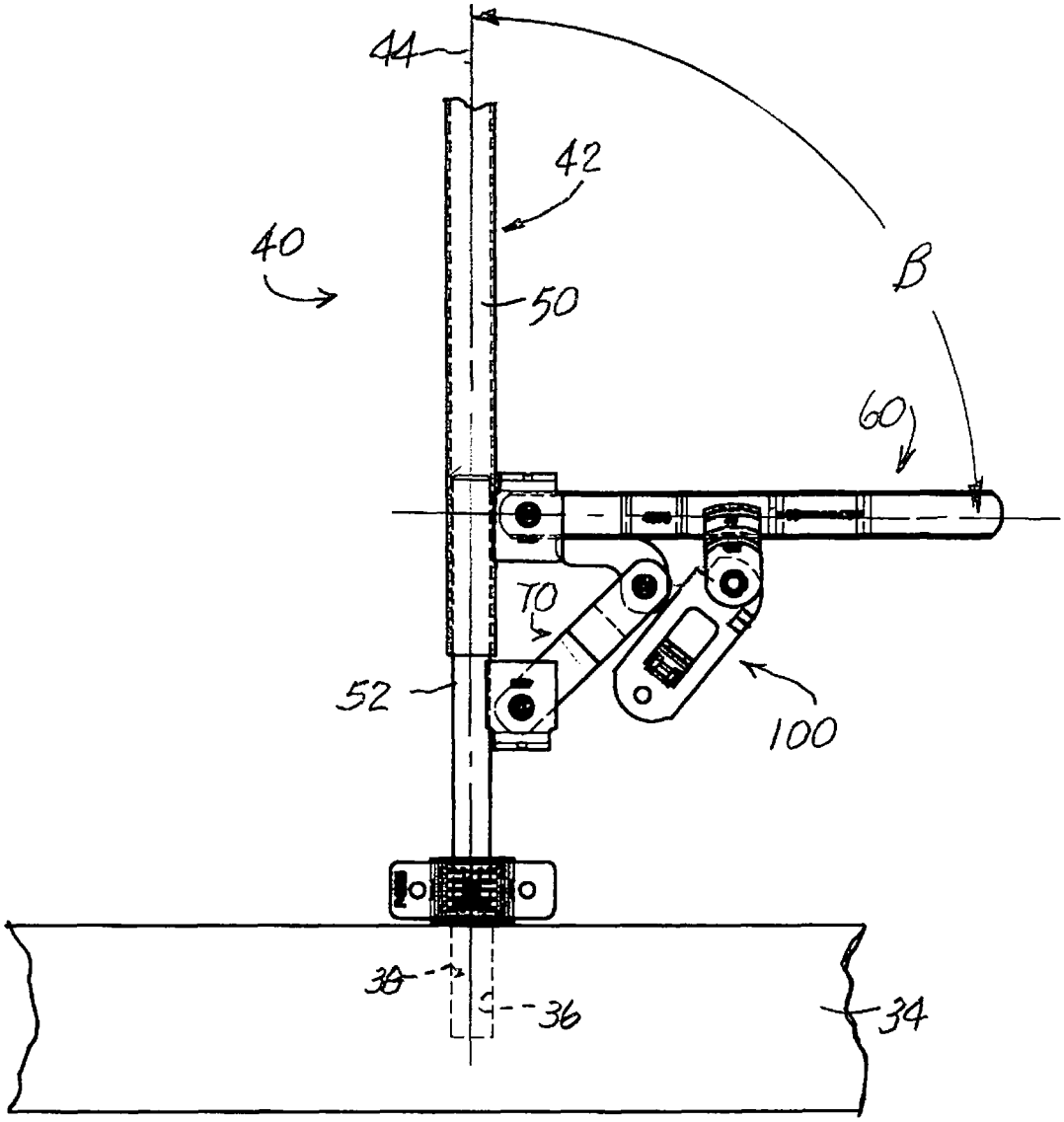
FIG. 5 is a fragmentary view similar to that shown in FIG. 2 but showing the bar lock assembly in an unlocked condition or position.

In the embodiment illustrated in FIGS. 2 and 3, the lock rod 42 includes a first axially elongated and preferably tubular lock rod portion 50 and a second lock rod portion 52. With the bar lock assembly in a locked condition or position, the second lock rod portion 52 extends from a lowermost end of and is arranged in telescoping and sliding relation relative to the first lock rod portion 50. That is, with the bar lock assembly in a locked condition or position, a lengthwise section of the second portion 52 of the lock rod 42 is slidably extendable within and from the lowermost end of the first lock rod portion 50. A free end of the second portion 52 of lock rod 42 is configured to be removably received in the aperture 36 defined by the floor extension 34 when bar lock assembly 40 is a locked condition to releasably maintain the doors 28, 30 in the closed or locked condition. As will be described below, and as illustrated in FIG. 5, with the bar lock assembly 40 in an unlocked condition or position, the second portion 52 of lock rod 42 is substantially retracted within the first lock rod portion 50 of lock rod 42 such that the free end of the second portion 52 of lock rod 42 is free from the marginal edge 38 of the aperture 36 whereby allowing the doors 28, 30 to be swung toward their open position or condition.

To promote rotational movements and positioning of the lock rod 42, and as shown in FIG. 2, the bar lock assembly 40 further includes an elongated, rigid, generally flat and preferably metal handle 60 having opposed ends 62 and 64. The first end 62 of handle 60 is pivotally or articulately connected about a fixed pivot point defined by pin 63 directly to the first lock rod portion 50 of lock rod 42 to effect rotational movements of the bar lock assembly 40 about axis 44. That is, and other than the articulate connection, in a preferred embodiment, there are no linkages between the end 62 of handle 60 and the first lock rod portion 50 of the lock rod 42. As such, the first end 62 of handle 60 is pivotally connected at a fixed pivot point 63 to the first lock rod portion 50 of lock rod 42 such that the handle 60 is limited to move in a fixed arc about pin 63 whereat handle 60 is articulately connected to the first lock rod portion 50. The second end 64 of handle 60 is free for grasping by an operator.

As shown in FIG. 3, linkage 70 serves to connect the handle 60 to the second lock rod portion 52 of lock rod 42. In one form, linkage 70 includes a link 72 articulately or pivotally connected toward a first end 74 to handle 60 by a pivot pin 67 at a location disposed in linearly spaced relation from the fixed pivot point 63 whereat the handle 60 is articulately connected to the first lock rod portion 50 of lock rod 42. An opposed or second end 76 of link 72 is articulately or pivotally connected by a pivot pin 69 to the second lock rod portion 52 of lock rod 42. As such, and when handle 60 is rotated about pin 63, through its fixed arc, from the first or locked condition (FIGS. 1 through 3) toward the second or unlocked condition (FIGS. 5 and 6), the upward movement of handle 60 causes the second lock rod portion 52 of lock rod 42 to telescopically move or elevate a sufficient distance into the first lock rod portion 50 of the lock rod 42 whereby removing or releasing the second portion 52 of lock rod 42 and from the confines of aperture 36.

Preferably, the first end 74 of link 72 of linkage 70 is configured or designed with a fork-like or clevis configuration including a pair of rigidly interconnected and spaced arms 75, 75' which closely embrace and straddle opposed sides of the handle 60 therebetween. The pivot pin 67 extends through the handle 60 and arms 75, 75' of link 72. The second end 76 of link 72 is rigidly connected to and depends from arms 75, 75' and is connected as by pin 69 to the second lock rod portion 52 of lock rod 42.

In the embodiment illustrated by way of example in FIG. 2, to enhance the ergonomic operation of the bar lock assembly 40, and unlike conventional bar lock assemblies, the handle 60 and linkage 70 of the bar lock assembly 40 are so designed and configured such that an included angle θ ranging between about 35 degrees and 50 degrees is defined between the handle 60 and the longitudinal axis 44 of the bar lock assembly when the bar lock assembly 40 is in a locked position or condition. In a most preferred embodiment, and to further distinguish the subject bar lock assembly from known bar lock assemblies, the handle 60 and linkage 70 of the bar lock assembly 40 are so designed and configured such that the included angle θ measures about 45 degrees between the handle 60 and the longitudinal axis 44 of the bar lock assembly when the bar lock assembly 40 is in a locked position or condition.

Figure 6:
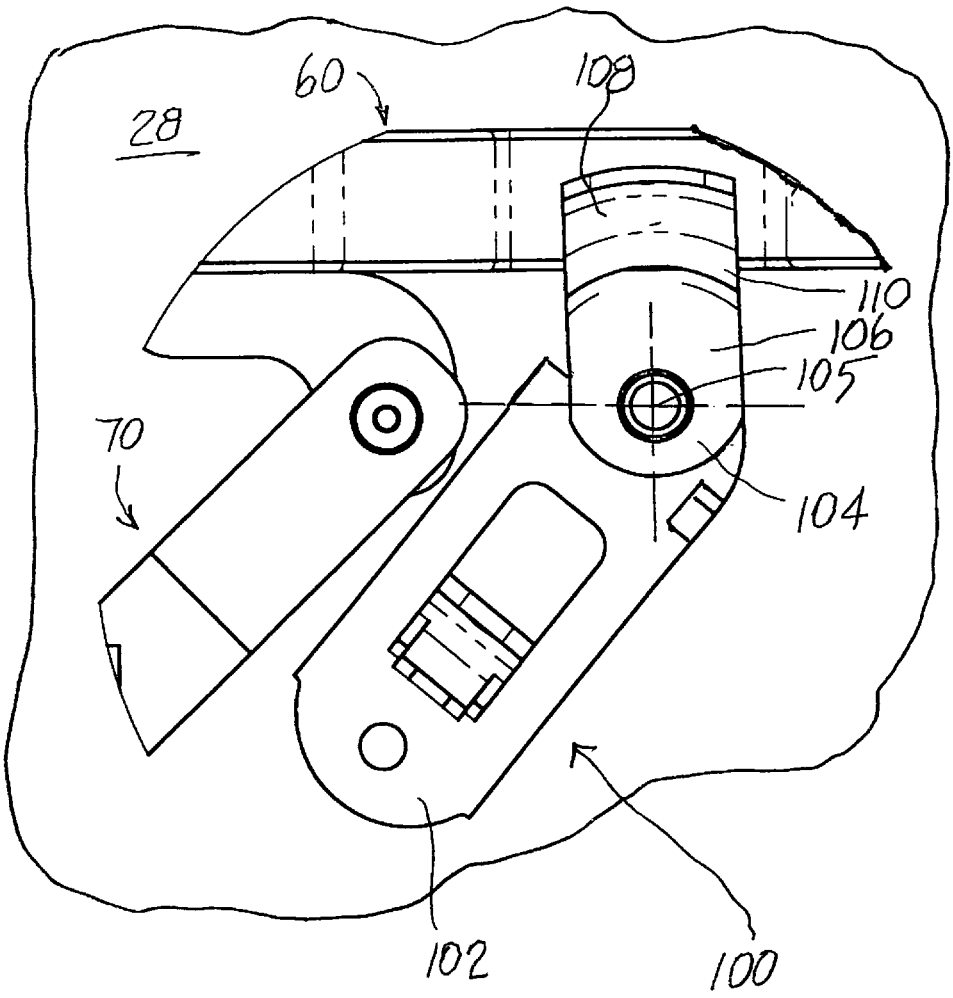
FIG. 6 is an enlarged fragmentary view similar to FIG. 3 but showing the bar lock assembly in an unlocked condition or position.

In the embodiment illustrated by way of example in FIGS. 5 and 6, and to further enhance the ergonomic operation of the bar lock assembly 40, unlike conventional bar lock assemblies, the handle 60 and linkage 70 of the bar lock assembly 40 are so designed and configured such that at an included angle β of about 90 degrees is defined between the handle 60 and the longitudinal axis 44 of the bar lock assembly 40 when the bar lock assembly 40 is in a second or unlocked position or condition. That is, and to further distinguish the subject bar lock assembly from known bar lock assemblies, the handle 60 and linkage 70 of the bar lock assembly 40 are so designed and configured such that the handle 60 of the bar lock assembly 40 extends generally perpendicular to the longitudinal axis 44 of the bar lock assembly 40 when the bar lock assembly 40 is in a second or unlocked position or condition.

In one form of the invention disclosure, the bar lock assembly 40 further includes structure 80 for pivotally connecting the handle 60 to the first lock rod portion 50. Preferably, structure 80 includes an inverted generally U-shaped bracket 82 having a top piece 84 that extends over an upper edge of the handle 60 and spaced side pieces 86, 86' rigidly joined to and depending from the top piece 84 and which closely embrace and straddle opposed sides of the handle 60. The pivot pin 63 extends through the handle 60 and side pieces 86, 86' of bracket 82. In one form, bracket 82 is welded or otherwise suitably fastened and extends radially from first lock rod portion 50 such that it will transmute movements of the handle 60 from and toward the door 28 into rotational movements of the lock rod 42. That is, movements of the handle 60 toward or away from the door 28 will rotate or turn the lock rod assembly 40 about its longitudinal axis 44 to move the camming structure 46 (FIGS. 1 and 2) into and out of interengaging relationship with the keeper 48 (FIG. 2).

In one form of the invention disclosure, the bar lock assembly 40 further includes structure 90 for pivotally connecting the second end 76 of link 72 to the second lock rod portion 50. Preferably, structure 90 includes a generally U-shaped bracket 92 having a lower piece 94 and spaced side pieces 96, 96' rigidly joined to and projecting vertically upward from the piece 94 and which closely embrace and straddle opposed sides of second end 76 of link 72. The pivot pin 69 extends through the second end 76 of link 72 and side pieces 96, 96' of bracket 96. In one form, bracket 92 is welded or otherwise suitably fastened to and extends radially from second lock rod portion 52. As such, vertical lifting movements of the handle 60 will be transmitted to the second lock rod portion 52. That is, pivotal lifting movements of the handle 60 about pivot pin 63 will cause the second portion 52 of the lock rod assembly 40 to telescopically move relative to the first lock rod portion 50 thereby removing the second portion 52 of the bar lock assembly 40 from engagement with the marginal edge of 38 of aperture 36 thereby conditioning the lock rod assembly 40 into an unlocked condition or position. As the handle 60 is being lifted, it can be simultaneously pulled away from the door 28 to rotate the lock assembly 40 and move the door 28 toward an open position.

As will be evident from an understanding thereof, structures 80 and 90 advantageously offer multiple benefits to the bar lock assembly 40. First, the structure 80 for articulately connecting handle 60 to the first lock rod portion 52 is preferably configured such that it serves as a positive stop for limiting pivotal movement of the handle 60 about the fixed pivot point 63. Second, structures 80 and 90 advantageously serve to limit axial displacement of the second portion 52 of lock rod 42 relative to the first portion 50 while permitting rotational movements of the first lock rod portion 50 about the longitudinal axis 44 of lock rod assembly 40. Furthermore, structures 80 and 90 are advantageously designed and configured to affect simultaneous rotation of both the first and second lock rod portions 50 and 52, respectively, relative to each other as handle 60 rotates the bar lock assembly 40 about its rotational axis 44.

In a preferred embodiment, a lock 100 is carried on the door 28. When the bar lock assembly 40 is in a first or locked position or condition, lock 100 holds handle 60 in a fixed position extending at an acute angle ranging between about 35° and about 50° relative to the longitudinal axis 44 of the bar lock assembly 40 and adjacent to the door 20. As will be appreciated from an understanding of this invention disclosure, in such position or condition, the camming structure 46 operably engages with keeper 48 and the second portion 52 of the lock rod 42 extends, at least partially, within the aperture 36 defined by the floor extension 34.

Figure 4:
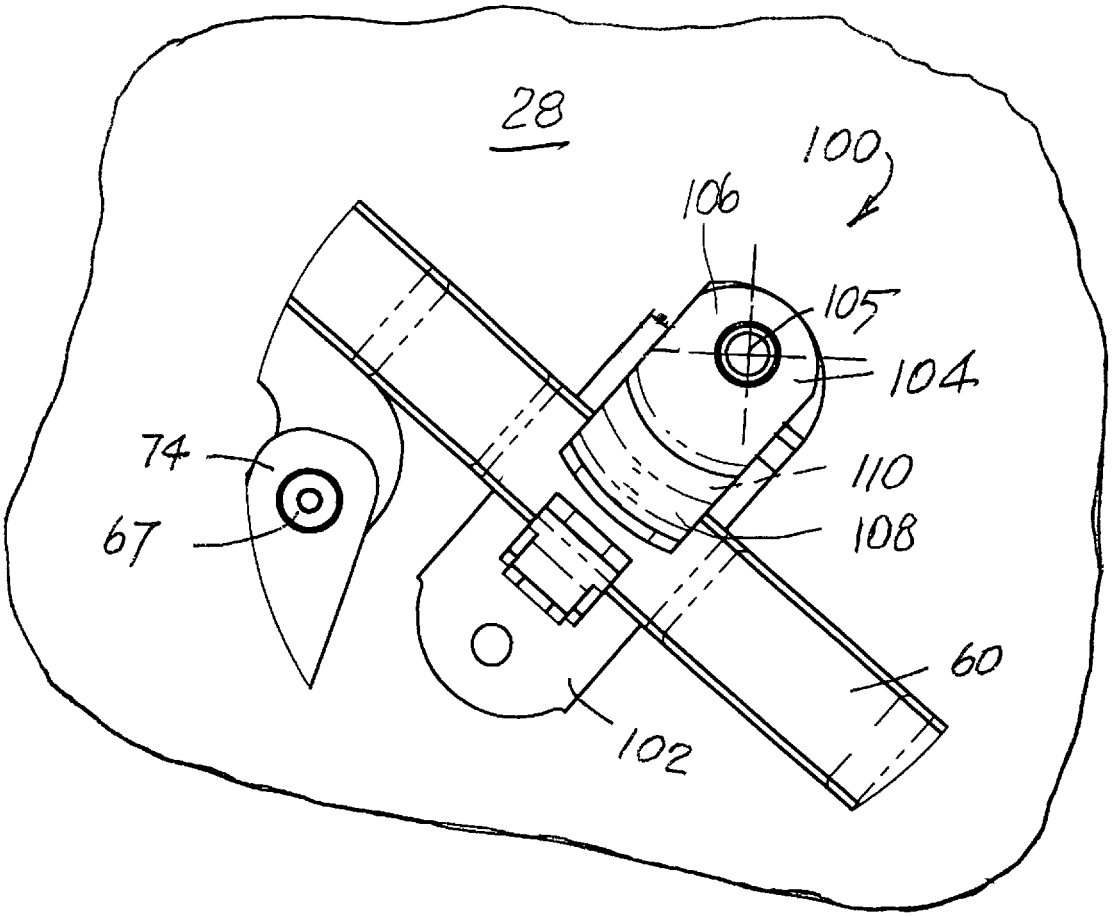
FIG. 4 is an enlarged fragmentary view of one form of lock arranged in operable combination with the bar lock assembly.

As illustrated by way of example in FIG. 4, lock 100 is designed as a hasp lock and includes a first hasp piece 102 mounted to the door 28 and a second hasp piece 104 which rotates relative to the first hasp piece 102 about a fixed axis 105 between first and second positions. As is known in the art, the second piece 104 of lock 100 includes a mounting portion 106 arranged adjacent and generally parallel to the first piece 102 and a locking portion 108. The locking portion 108 is rigidly joined to and moves with the mounting portion 106. The locking portion 108 is rigidly joined to the mounting portion by an off-set step portion 110. The step portion 110 of the lock piece 104 positions the locking portion 108 of piece 104 in front of the handle 60 and relative to the first piece 102 such that, when lock 100 is in a first or locked position (FIG. 4), together they form a recess that receives and holds the handle 60 in a first or locked condition or position with the camming structure 46 operably engaged with the keeper 48 and the second portion 52 of the lock rod 42 extending, at least partially within the aperture 36 defined by the floor extension 34.

The handle 60 can be removed from lock 100 by pivoting the second hasp piece 104 about axis 105 and then lifting handle 60 from the recess formed by the lock 100. Handle 60 can be simultaneously pulled in a direction away from the door 28 so as to rotate the lock rod 42 about its longitudinal axis 44 and to swing the door 28 toward an open position. As will be appreciated from an understanding of this invention disclosure, sufficient lifting of handle 60 from the recess formed by lock 100 will also result in linkage 70 forcibly raising and removing the second lock rod portion 52 of lock rod 42 from the confines of aperture 36 formed by the floor extension 34 while rotation of the lock rod 42 will simultaneously cause the camming structure 46 to operably disengage from the keeper 48 so as to allow the door 28 to be swung toward an open position.

Advantageously, and as shown in FIG. 5, once the handle 60 is sufficiently moved to a second or unlocked position, whereat handle 60 extends generally orthogonal to the axis 44 of the lock rod assembly 40 and the door 28 has been swung away from its closed position, the handle 60 can be again moved toward the door 28 and held by the lock 100. That is, when handle 60 is moved to the position shown in FIG. 5 and adjacent the door 28, the lock 100 is advantageously mounted on the door 28 to releasably hold and maintain the handle 60 in position extending generally perpendicular to the axis 44 of the bar lock assembly 40 so as to hold and maintain the second portion 52 of the lock rod 42 out of engagement with the aperture 36.

To hold the handle 60 in the position illustrated in FIG. 5, the second piece 104 of lock 100 is rotated about axis 105 such that the handle 60 is entrapped between the raised locking portion 108 and the exterior of door 28. In such position, a lower edge of handle 60 rests on and is supported by the step portion 110 of lock piece 104 whereby preventing the handle 60 from falling and, thus, maintaining the second portion 52 of lock rod 42 in a raised position or condition and out of engagement with the aperture 36.

From the above description, it will be apparent that the design and configuration of the present invention disclosure offers several unique qualities to the state of the art. First, the fixed pivot point 63 and fixed arc about which the handle 60 rotates when the bar lock assembly 40 transitions between locked and unlocked conditions or positions yields stability and accurate movements to the handle 60. Second, designing and configuring the bar lock assembly 40 such that the handle 60 is disposed at an included angle ranging between about 35 degrees and about 50 degrees relative to the longitudinal axis 44 of the bar lock assembly 40 when the bar lock assembly 40 is in a locked condition and the door 28 is in a closed condition or position yields additional and heretofore unknown benefits. That is, designing and configuring the bar lock assembly 40 such that the handle 60 is disposed at an included angle ranging between about 35 degrees and about 50 degrees relative to the longitudinal axis 44 of the bar lock assembly 40 when the bar lock assembly 40 is in a locked condition with door 28 is in a closed or locked position distinguishes and identifies the bar lock assembly 40 as being different than others. Also, the acutely angled and lowered position of the handle 60 when the bar lock assembly 40 is in a first or locked condition ergonomically facilitates operation of the bar lock assembly 40. That is, the acutely angled and lowered position of the handle 60 when the bar lock assembly 40 is in a first or locked condition advantageously facilitates and promotes one-handed opening movement involving simultaneous lifting and rotating movements to be imparted to the lock rod 42 as the door 28 moves from a closed toward an open position. Moreover, designing and configuring the bar lock assembly 40 such that movements of the handle 60 are limited to a range disposed generally below horizontal as the bar lock assembly 40 is moved between locked and unlocked positions or conditions furthermore yields heretofore unknown ergonomic benefits.

From the foregoing, it will be observed numerous modifications and variations can be made and effected without departing or detracting from the true spirit and novel concept of the present invention disclosure. Moreover, it will be appreciated, the present invention disclosure is intended to set forth an exemplification of the invention disclosure which is not intended to limit the invention disclosure to the specific embodiment illustrated. Rather, this disclosure is intended to cover by the appended claims all such modification and variations as fall within the spirit and scope of the claims.

What is claimed is:

1. A bar lock assembly, comprising:

a lock rod defining a rotational axis for said bar lock assembly and including a first lock rod portion and a second lock rod portion arranged in telescoping relationship relative to each other, with a lengthwise section of said second lock rod extending from a first end of said first lock rod portion when said bar lock assembly is in a first condition, and with second lock rod portion being substantially retracted within said first look rod portion when said bar lock assembly is in a second condition;

an elongated handle having opposed ends and a longitudinal axis extending between said opposed ends, with one end of said handle being pivotally connected at a first pivot point to the first lock rod portion to effect rotational movements of said bar lock assembly about said rotational axis as said handle is moved toward and away from a door and such that said handle moves in an arc about the first pivot point whereat said handle is connected to said first lock rod portion;

linkage connected to said second lock rod portion at a second pivot point for telescopically moving said second lock rod portion relative to said first lock rod portion in response to pivotal movement of said handle about said first pivot point, with said linkage being connected to said handle at a third pivot point, and with said third pivot point being offset from the other two pivot points as well as from the longitudinal axis of said handle; and wherein said linkage and said handle are configured such that an included angle ranging between about 35° and about 50° is defined between said handle and the rotational axis of said bar lock assembly when said bar lock assembly is in said first condition so as to facilitate one-handed operation of said bar lock assembly.

2. The bar lock assembly according to claim 1, further including a locking cam coupled to a second end of said first lock rod portion and adapted to engage a lock rod keeper.

3. The bar lock assembly according to claim 1, further including structure secured to and extending from said second lock rod portion for articulately connecting said linkage and said second lock rod portion to each other.

4. A bar lock assembly, comprising:

a lock rod defining a rotational axis for said bar lock assembly and including a first lock rod portion and a second lock rod portion arranged in telescoping relationship relative to each other, with a lengthwise section of said second lock rod extending from a first end of said first lock rod portion when said bar lock assembly is in a first condition, and with second lock rod portion being substantially retracted within said first lock rod portion when said bar lock assembly is in a second condition;

structure disposed along the length of said second lock rod portion for limiting axial displacement of said second lock rod portion relative to said first lock rod portion while permitting rotational movements of said first lock rod portion about the rotational axis of said bar lock assembly;

an elongated handle having opposed ends, with one end of said handle being pivotally connected to the first lock rod portion to effect rotational movements of said bar lock assembly about said rotational axis as said handle is moved toward and away from a door and such that said handle moves in an arc about a fixed pivot point whereat said handle is connected to said first lock rod portion;

linkage connected between said handle and said second lock rod portion for telescopically moving said second lock rod portion relative to said first lock rod portion in response to pivotal movement of said handle about said fixed pivot point and;

wherein said linkage and said handle are configured such that an included angle ranging between about 35° and about 50° is defined between said handle and the rotational axis of said bar lock assembly when said bar lock assembly is in said first condition.

5. The bar lock assembly according to claim 1, further including structure secured to and extending from said first and second lock rod portions for allowing said handle and said linkage to be articulately connected to said first and second lock rod portions, respectively, and wherein said handle, said linkage and said structure are all configured to effect simultaneous rotation of both the first lock rod portion and the second lock rod portion as said handle is pivotally moved about the fixed pivot point and moved toward or away from the door on which said bar lock assembly is mounted.

6. A bar lock assembly, comprising:

an elongated lock rod defining a rotational axis for said bar lock assembly and including a first lock rod portion and a second lock rod portion arranged in telescoping relationship relative to each other, with a lengthwise section of said second lock rod portion extending from a first end of said first lock rod portion when said bar lock assembly is in a first condition, and with the second lock rod portion being substantially retracted within said first lock rod portion when said bar lock assembly is in a second condition;

an elongated handle having opposed ends and a longitudinal axis extending between said opposed ends, with one end of said handle being articulately connected art a first pivot point to structure secured to and extending from the first lock rod portion to effect rotational movements of said bar lock assembly about said rotational axis and such that said handle moves in an arc about a fixed pivot point whereat said handle is connected to said first lock rod portion;

linkage connected to said handle at a second pivot point on said handle and to structure secured to and extending from said second lock rod portion for telescopically Moving said second lock rod portion relative to said first lock rod portion in response to pivotal movements of said handle about said first pivot point, with the second pivot for said linkage being offset from the longitudinal axis of said handle; and wherein said linkage and said handle are configured such that said handle is disposed generally parallel to a horizontal plane when said bar lock assembly is in said second condition to enhance ergonomic operation of said bar lock assembly.

7. The bar lock assembly according to claim 6, further including a locking cam coupled to a second end of said first lock rod portion and adapted to engage a lock rod keeper.

8. A bar lock assembly, comprising:

an elongated lock rod defining a rotational axis for said bar lock assembly and including a first lock rod portion and a second lock rod portion arranged in telescoping relationship relative to each other, with a lengthwise section of said second lock rod portion extending from a first end of said first lock rod portion when said bar lock assembly is in a first condition, and with second lock rod portion being substantially retracted within said first lock rod portion when said bar lock assembly is in a second condition;

an elongated handle having opposed ends, with one end of said handle being articulately connected to structure secured to and extending from the first look rod portion to effect rotational movements of said bar lock assembly about said rotational axis and such that said handle moves in an arc about a fixed pivot point whereat said handle is connected to said first lock rod portion, and, wherein the structure for articulately connecting said handle to said first lock rod portion acts as a positive stop for limiting pivotal movement of said handle about said fixed pivot point;

linkage connected between said handle and the structure secured to and extending from said second lock rod portion for telescopically moving said second lock rod portion relative to said first lock rod portion in response to pivotal movements of said handle about said first pivot point; and wherein said linkage and said handle are configured such that said handle is disposed generally parallel to a horizontal plane when said bar lock assembly is in said second condition to enhance ergonomic operation of said bar lock assembly.

9. A bar lock assembly, comprising:

an elongated lock rod defining a rotational axis for said bar lock assembly and including a first lock rod portion and a second lock rod portion arranged in telescoping relationship relative to each other, with a lengthwise section of said second lock rod portion extending from a first end of said first lock rod portion when said bar lock assembly is in a first condition, and with second lock rod portion being substantially retracted within said first lock rod portion when said bar lock assembly is in a second condition;

an elongated handle having opposed ends, with one end of said handle being articulately connected to structure secured to and extending from the first lock rod portion to effect rotational movements of said bar lock assembly about said rotational axis and such that said handle moves in an arc about a fixed pivot point whereat said handle is connected to said first lock rod portion;

linkage connected between said handle and structure secured to and extending from said second lock rod portion for telescopically moving said second lock rod portion relative to said first lock rod portion in response to pivotal movements of said handle about said first pivot point, wherein the structure secured to and extending from the second lock rod portion limits axial displacement of said second lock rod portion relative to said first lock rod portion while permitting rotational movements of said first lock rod portion about the rotational axis of said bar lock assembly; and wherein said linkage and said handle are configured such that said handle is disposed generally parallel to a horizontal plane when said bar lock assembly is in said second condition to enhance ergonomic operation of said bar lock assembly.

10. The bar lock assembly according to claim 9, wherein said handle, said linkage, said structure secured to and extending from the first lock rod portion, and said structure secured to and extending from said second lock rod portion are configured to simultaneously rotate both the first lock rod portion and the second lock rod portion as said handle rotates said bar lock assembly about its rotational axis.

11. A bar lock assembly for a door of a container, with the container having a generally horizontal floor extension extending across and outward from a lower surface of the door, and a door frame with the door being movably mounted to the door frame, said bar lock assembly comprising:

an elongated lock rod configured to be mounted to the door for rotation about a fixed axis, with said lock rod including a first lock rod portion and a second lock rod portion arranged in telescoping relationship relative to said first lock rod portion, with a lengthwise section of said second lock rod portion extending from a lower end of said first lock rod portion and is configured to be received in an aperture defined by said floor extension to lock the door relative to the frame when said bar lock assembly is in a locked condition, and with second lock rod portion being substantially retracted within said first lock rod portion, removed from the aperture defined by said floor extension, when said bar lock assembly is in an unlocked condition;

a locking cam mounted to an upper end of the elongated lock rod and adapted to engage a lock rod keeper mounted to the door frame;

an elongated handle having one end pivotally connected to the first lock rod portion of said lock rod to effect rotational movements of said bar lock assembly about said rotational axis, with said handle being movable in an arc about a fixed pivot point whereat said handle is connected to said first lock rod portion, and with said handle having a free second end, and with said elongated handle having a longitudinal axis extending between said ends;

linkage connected to said handle at a pivot offset from the longitudinal axis thereof and to said second lock rod portion for telescopically moving said second lock rod portion relative to said first lock rod portion so as to condition said bar lock assembly into an unlocked condition in response to pivotal movement of said handle about said fixed pivot point; and wherein said linkage and said handle are configured such that said handle is disposed generally parallel to a horizontal plane when said bar lock assembly is in said unlocked condition to enhance leverage on said handle during operation of said bar lock assembly.

12. The bar lock assembly according to claim 11, wherein said floor extension defines a closed marginal edge for said aperture.

13. A bar lock assembly for a door of a container, with the container having a generally horizontal floor extension extending across and outward from a lower surface of the door, and a door frame with the door being movably mounted to the door frame, with said bar lock assembly comprising:

an elongated lock rod configured to be mounted to the door for rotation about a fixed axis, with said lock rod including a first lock rod portion and a second lock rod portion arranged in telescoping relationship relative to said first lock rod portion, with a lengthwise section of said second lock rod portion extending from a lower end of said first lock rod portion and is configured to be received in an aperture defined by said floor extension to lock the door relative to the frame when said bar lock assembly is in a locked condition, and with second lock rod portion being substantially retracted within said first rod portion, removed from the aperture defined by said floor extension, when said bar lock assembly is in an unlocked condition;

a locking cam mounted to an upper end of the elongated lock rod and adapted to engage a lock rod keeper mounted to the door frame;

an elongated handle having one end pivotally connected to the first lock rod portion of said lock rod to effect rotational movements of said bar lock assembly about said rotational axis, with said handle being movable in an arc about a fixed pivot point whereat said handle is connected to said first lock rod portion, and with said handle having a free second end;

linkage connected between said handle and said second lock rod portion for telescopically moving said second lock rod portion relative to said first lock rod portion so as to condition said bar lock assembly into an unlocked condition in response to pivotal movement of said handle about said fixed pivot point;

wherein said linkage and handle are configured such that said handle is disposed generally parallel to a horizontal plane when said bar lock assembly is in said unlocked condition to enhance leverage on said handle during operation of said bar lock assembly; and a two-piece lock carried by said door, with said two-piece lock including a first piece mounted to the door, and a second piece which rotates relative to said first piece about a fixed axis defined by said first piece between first and second positions, and with said second lock piece rotated to the second position, said second lock piece is positioned to engage and position a lengthwise portion of said handle such that a free end of the second portion of said lock rod is releasably held above and free of the marginal edge of the aperture defined by said floor extension whereby maintaining said bar lock assembly in the unlocked condition.

14. The bar lock assembly according to claim 13, wherein when said second lock piece is in said first position, said second lock piece cooperates with said first lock piece of said lock to entrap a lengthwise portion of said handle therebetween so as to inhibit inadvertent movements of said handle whereby rotation of said bar lock assembly is prevented.

15. A bar lock assembly for a door of a container, with the container having a generally horizontal floor extension extending across and outward from a lower surface of the door, and a door frame with the door being movably mounted to the door frame, said bar lock assembly comprising:

an elongated lock rod configured to be mounted to the door for rotation about a fixed axis, with said lock rod including a first lock rod portion and a second lock rod portion arranged in telescoping relationship relative to said first lock rod portion, with a lengthwise section of said second lock rod portion extending from a lower end of said first lock rod portion and is configured to be received in an aperture defined by said floor extension to lock the door relative to the frame when said bar lock assembly is in a locked condition, and with second lock rod portion being substantially retracted within said first elongated portion, removed from the aperture defined by said floor extension, when said bar lock assembly is in an unlocked condition;

a locking cam mounted to an upper end of the elongated lock rod and adapted to engage a lock rod keeper mounted to the door frame;

structure secured to and extending from said first lock rod portion for pivotally connecting one end of an elongated handle to the first lock rod portion to effect rotational movements of said bar lock assembly about said rotational axis, and with said handle being movable in an arc about a fixed pivot point whereat said handle is connected to said first lock rod portion, and with said handle having a free second end, and wherein said structure secured to and extending from said first lock rod portion serving as a positive stop for limiting pivotal movement of said handle about said fixed pivot point;

linkage connected between said handle and said second lock rod portion for telescopically moving said second lock rod portion relative to said first lock rod portion so as to condition said bar lock assembly into an unlocked condition in response to pivotal movement of said handle about said fixed pivot point; and wherein said linkage and said handle are configured such that said handle is disposed generally parallel to a horizontal plane when said bar lock assembly is in said unlocked condition to enhance leverage on said handle during operation of said bar lock assembly.

16. A bar lock assembly for a door of a container, with the container having a generally horizontal floor extension extending across and outward from a lower surface of the door, and a door frame with the door being Movably mounted to the door frame, with said bar lock assembly comprising:

an elongated lock rod configured to be mounted to the door for rotation about a fixed axis with said lock rod including a first lock rod portion and a second lock rod portion arranged in telescoping relationship relative to said first lock rod portion, with a lengthwise section of said second lock rod portion extending from a lower end of said first lock rod portion and is configured to be received in an aperture defined by said floor extension to lock the door relative to the frame when said bar lock assembly is in a locked condition, and with second lock rod portion being substantially retracted within said first lock rod portion, removed from the aperture defined by said floor extension, when said bar lock assembly is in an unlocked condition;

a locking cam mounted to an upper end of the elongated lock rod and adapted to engage a lock rod keeper mounted to the door frame;

an elongated handle having one end pivotally connected to the first lock rod portion of said lock rod to effect rotational movements of said bar lock assembly about said rotational axis, with said handle being movable in an arc about a fixed pivot point whereat said handle is connected to said first lock rod portion, and with said handle having a free second end;

structure disposed along the length of and carried by said second lock rod portion for limiting axial displacement of said second lock rod portion relative to said first lock rod portion while permitting rotational fore-and-aft movements of said handle about the rotational axis of said bar lock assembly;

linkage connected between said handle and said second lock rod portion for telescopically moving said second lock rod portion relative to said first lock rod portion so as to condition said bar lock assembly into an unlocked condition in a response to pivotal movement of said handle about said fixed pivot point:

wherein said linkage and handle are configured such that said handle is disposed generally parallel to a horizontal plane when said bar lock assembly is in said unlocked condition to enhance leverage on said handle during operation of said bar lock assembly.

17. The bar lock assembly according to claim 11, further including structure secured to and extending from said first and second lock rod portions for allowing said handle and said linkage to be articulately connected to said first and second lock rod portions, respectively, and wherein said handle, said linkage and said structure secured to and extending from said first and second lock rod portions are configured to effect simultaneous rotation of both the first lock rod portion and the second lock rod portion as said handle rotates said bar lock assembly about its rotational axis.

18. A bar lock assembly for a door of a container, with the container having a generally horizontal floor extension extending across and outward from a lower surface of the door and a door frame with the door being movably mounted to the door frame, said bar lock assembly comprising:

an elongated lock rod configured to be mounted to the door for rotation about a fixed axis, with said lock rod including a first lock rod portion and a second lock rod portion arranged in telescoping relationship relative to said first lock rod portion, with a lengthwise section of said second lock rod portion extending from a lower end of said first lock rod portion and is configured to be received in an aperture defined by said floor extension to lock the door relative to the frame when said bar lock assembly is in a locked condition, and with the second lock rod portion being substantially retracted within said first lock rod portion removed from the aperture defined by said floor extension when said bar lock assembly is in an unlocked condition;

a locking cam mounted to an upper end of the lock rod and adapted to engage a lock rod keeper coupled to the door frame;

an elongated handle defining a longitudinal axis and having one end pivotally connected at a fixed pivot point to the first lock rod portion of said lock rod to effect rotational movements of said bar lock assembly about said rotational axis, with said handle moving in an arc about said first fixed pivot point whereat said handle is connected to said first lock rod portion, and with said handle having a free second end;

linkage connected to said handle at a second pivot point and to said second lock rod portion of said bar lock assembly at a third pivot point for telescopically moving said second lock rod portion relative to said first lock rod portion in response to pivotal movement of said handle about said fixed pivot point, and with said second pivot point being offset from the other two pivot points as well as from the longitudinal axis of said handle; and wherein said linkage and said handle are configured such that said handle is disposed at an included angle of about 35° to about 50° between said handle and a horizontal plane when said bar lock assembly is in said locked condition.

19. The bar lock assembly according to claim 18, wherein said floor extension defines a closed marginal edge for said aperture.

20. A bar lock assembly for a door of a container, with the container having a generally horizontal floor extension extending across and outward from a lower surface of the door, and a door frame with the door being movably mounted to the door frame, said bar lock assembly comprising:

an elongated lock rod configured to be mounted to the door for rotation about a fixed axis, with said lock rod including a first lock rod portion and a second lock rod portion arranged in telescoping relationship relative to said first lock rod portion, with a lengthwise section of said second lock rod portion extending from a lower end of said first lock rod portion and is configured to be received in an aperture defined by said floor extension to lock the door relative to the frame when said bar lock assembly is in a locked condition, and with the second lock rod portion being substantially retracted within said first lock rod portion, removed from the aperture defined by said floor extension, when said bar lock assembly is in an unlocked condition;

a locking cam mounted to an upper end of the elongated lock rod and adapted to engage a lock rod keeper coupled to the door frame;

an elongated handle having one end pivotally connected to the first lock rod portion of said lock rod to effect rotational movements of said bar lock assembly about said rotational axis, with said handle being movable in an arc about a fixed pivot point whereat said handle is connected to said first lock rod portion, and with said handle having a free second end;

linkage connected between said handle and said second lock rod portion of said bar lock assembly for telescopically moving said second lock rod portion relative to said first lock rod portion in response to pivotal movement of said handle about said fixed pivot point;

wherein said linkage and handle are configured such that said handle is disposed at an included angle of about 35° to about 50° between said handle and a horizontal plane when said bar lock assembly is in said unlocked condition; and a two-piece lock carried by said door, with said two-piece lock including a first piece mounted to the door, and a second piece which rotates relative to said first piece about a fixed axis defined by said first piece between first and second positions, and wherein, with said second lock piece being rotated to the second position, said second lock piece is positioned to engage and position a lengthwise portion of said handle such that a free end of the second portion of said lock rod is releasably held above and free of the marginal edge of the aperture defined by said floor extension whereby maintaining said bar lock assembly in the unlocked condition.

21. A bar lock assembly for a door of a container, with the container having a generally horizontal floor extension extending across and outward from a lower surface of the door, and a door frame with the door being movably mounted to the door frame, said bar lock assembly comprising:

an elongated lock rod configured to be mounted to the door for rotation about a fixed axis, with said lock rod including a first lock rod portion and a second lock rod portion arranged in telescoping relationship relative to said first lock rod portion, with a lengthwise section of said second lock rod portion extending from a lower end of said first lock rod portion and is configured to be received in an aperture defined by said floor extension to lock the door relative to the frame when said bar lock assembly is in a locked condition, and with the second lock rod portion being substantially retracted within said first portion removed from the aperture defined by said floor extension, when said bar lock assembly is in an unlocked condition;

a locking cam mounted to an upper end of the elongated lock rod and adapted to engage a lock rod keeper coupled to the door frame;

structure secured to and extending from said first lock rod portion for pivotally connecting a handle to the first lock rod portion of said bar lock assembly, with said handle being movable in an arc about a fixed pivot point, and with said handle having a free second end, and with said structure secured to and extending from said first lock rod portion serving as a positive stop for limiting pivotal movement of said handle about said fixed pivot point;

linkage connected between said handle and said second lock rod portion of said bar look assembly for telescopically moving said second look rod portion relative to said first lock rod portion in response to pivotal movement of said handle about said fixed pivot point;

wherein said linkage and handle are configured such that said handle is disposed at an included angle of about 35° to about 50° between said handle and a horizontal plane when said bar lock assembly is in said unlocked condition.

22. A bar lock assembly for a door of a container, with the container having a generally horizontal floor extension extending across and outward from a lower surface of the door, and a door frame with the door being movably mounted to the door frame, said bar lock assembly comprising:

an elongated lock rod configured to be mounted to the door for rotation about a fixed axis, with said lock rod including a first look rod portion and a second lock rod portion arranged in telescoping relationship relative to said first lock rod portion, with a lengthwise section of said second lock rod portion extending from a lower end of said first lock rod portion and is configured to be received in an aperture defined by said floor extension to lock the door relative to the frame when said bar lock assembly is in a locked condition, and with the second lock rod portion being substantially retracted within said first lock rod portion, removed from the aperture defined by said floor extension, when said bar lock assembly is in an unlocked condition;

a locking cam mounted to an upper end of the elongated lock rod and adapted to engage a lock rod keeper coupled to the door frame;

an elongated handle having one end pivotally connected to the first elongated lock rod portion to effect rotational movements of said bar lock assembly about said rotational axis, with said handle moving in an arc about a fixed pivot point whereat said handle is connected to said first lock rod portion, and with said handle having a free second end;

structure disposed along the length of and carried by said second lock rod portion for limiting axial displacement of said second lock rod portion relative to said first lock rod portion while permitting rotational fore-and-aft movements of said handle about the rotational axis of said bar lock assembly;

linkage connected between said handle and said second lock rod portion of said lock rod assembly for telescopically moving said second lock rod portion relative to said first lock rod portion in response to pivotal movement of said handle about said fixed pivot point; and wherein said linkage and handle are configured such that said handle is disposed at an included angle of about 35° to about 50° between said handle and a horizontal plane when said bar lock assembly is in said unlocked condition.

23. The bar lock assembly according to claim 18, further including structure secured to and extending from said first and second lock rod portions for allowing said handle and said linkage to be articulately connected to said first and second lock rod portions, respectively, and wherein said handle, said linkage and said structure are all configured to effect simultaneous rotation of both the first lock rod portion and the second lock rod portion as said handle rotates said bar lock assembly about its rotational axis.

* * * * *